United States Patent [19]

Sippola

[11] Patent Number: 4,526,127

[45] Date of Patent: Jul. 2, 1985

[54] APPARATUS FOR COATING STEEL OBJECTS WITH AN ALLOY OF ZINC AND ALUMINIUM

[75] Inventor: Pertti J. Sippola, Espoo, Finland

[73] Assignee: Ra-Shipping Ltd. Oy, Espoo, Finland

[21] Appl. No.: 556,019

[22] Filed: Nov. 29, 1983

[51] Int. Cl.[3] ..... B05C 3/02

[52] U.S. Cl. ..... 118/54; 118/64; 118/416; 118/426; 118/425; 118/429

[58] Field of Search ..... 118/52, 53, 54, 55, 118/418, 429, 56, 425, 64, 416

[56] References Cited

U.S. PATENT DOCUMENTS 1,418,412 6/1922 Watrous ..... 118/54

2,369,592 2/1945 Marinsky et al. ..... 118/52 X

*Primary Examiner*—John P. McIntosh

*Attorney, Agent, or Firm*—Scully, Scott, Murphy & Presser

[57] ABSTRACT

An apparatus for coating steel objects with an alloy of zinc and aluminium. The steel objects are preheated in a furnace to within 400°-950° C. within a protective reducing gas, and then introduced into a zinc bath containing about 5% aluminium in a cage. After a predetermined time, the cage is raised out of the bath into a centrifuging chamber having an oxygen-free atmosphere therein.

11 Claims, 4 Drawing Figures

A
A

APPARATUS FOR COATING STEEL OBJECTS WITH AN ALLOY OF ZINC AND ALUMINIUM

From the zinc coating of thin steel sheets it is known that a coating comprising an eutectic alloy of zinc and 5% aluminium is two to three times more durable in corrosion protection than a conventional zinc or iron/-zinc coating.

However, small steel products, such as bolts, cannot be coated with this zinc alloy by means of a conventional flux-based dip zinc coating method, because the flux reacts with the aluminium contained in the zinc, which results in a poor quality and adhesion of the coating. Further, in a conventional zinc coating method the excess zinc melt is removed, for example, form the threads of bolts by means of a centrifuge in an oxidizing atmosphere. When centrifuging the alloy of zinc and 5% aluminium, molten aluminium is rapidly oxidized while producing an aluminium oxide film on the melt surface, which prevents a uniform removal of excess molten metal from beneath the film.

According to the present invention, the steel objects to be coated are preheated to a temperature within the range 400° C.–950° C. in a furnace containing a protective, reducing gas and are introduced in a zinc bath containing at least approximately 5% of aluminium, into a cage which after a predetermined time is lifted out of the bath into a centrifuging chamber containing an oxygen-free atmosphere, such as nitrogen gas.

The present invention provides on apparatus by means of which small steel objects conveniently can be zinc-coated in the above summarized manner, when the temperature of the zinc bath is in the range 390° C. to 430° C.

The apparatus according to the invention mainly comprises a bath containing a molten alloy of zinc and aluminium, means for feeding steel objects, preheated to a temperature within the range 400° C.–950° C., into the bath, a centrifuging chamber above the bath and containing an oxygen-free atmosphere, a cage means movable between a first position within the bath, in which position the cage means is arranged to receive the steel objects fed into the bath, and a second position in the centrifuging chamber above the bath, in which second position the cage means is arranged to rotate in order to remove excess coating material from the steel objects, and means for removing the steel objects from the cage means to the outside of the centrifuging chamber, after the centrifugation.

Preferred embodiments of the apparatus will appear from the following detailed description where reference is made to the accompanying schematical drawing, as well as from the sub-claims.

Figures 1, 2:
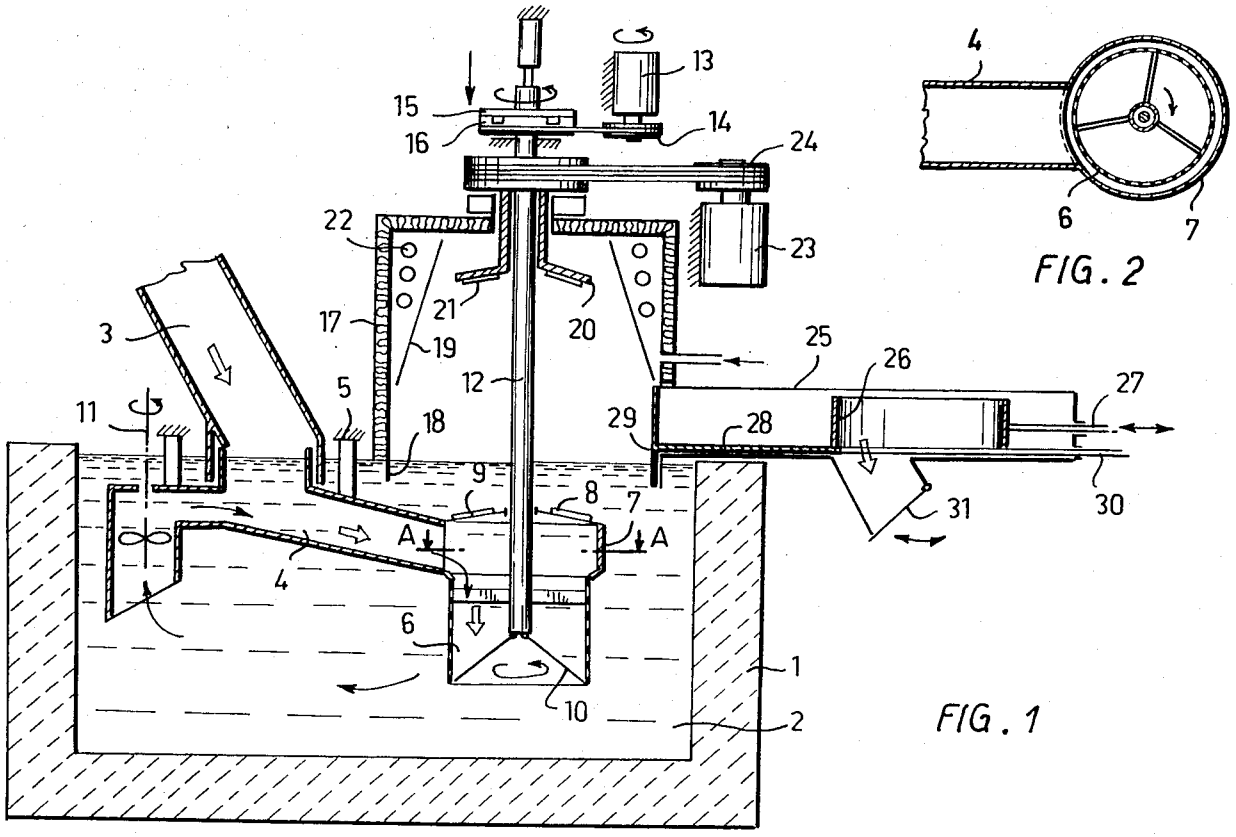
FIG. 1 illustrates the step of introducing the steel objects into the cage immersed in the zinc bath.
FIG. 2 is a section taken along line $A_1$–$A_2$ in FIG. 1.

In the drawing, reference numeral 1 designates a reservoir for a zinc bath 2 containing preferably 5% of aluminium, at least approximately. The temperature of the bath is preferably within the range 390° C. to 430° C.

The steel objects to be coated are indicated by short, thick arrows and are, before being fed into the bath, preheated to a temperature within the range 400° C. to 950° C. in a furnace containing a protective, reducing atmosphere. The furnace arrangement is not shown in the drawing since it as such is earlier known, as one example U.S. Pat. No. 4,170,495 can be mentioned.

As illustrated in FIG. 1, the objects to be coated enter the bath 2 through a protective chute 3 which together with a receiving conveyor pipe 4 forms a gas tight seal at the bath surface. The supports of pipe 4 are schematically indicated at 5. The objects proceed through pipe 4 conveyed by means of a molten metal flow indicated by longer narrow arrows and produced by a schematically shown pump 11 to a perforated centrifuging cage 6. The steel objects are prevented from leaving the centrifuging cage 6 by means of a guide ring 7 integral with the conveyor pipe 2 and by means of a cover 8 of the centrifuging cage. The centrifuging cage rotates all the time, at a speed of e.g. 20–60 r.p.m., by means of a motor 13, through a chain or belt transmission 14, a clutch 15, 16 and a shaft 12, while permitting a uniform placement of the steel objects on the conical bottom 10 of the cage 6. The time the cage stays in the bath can be adjusted steplessly, by the use of arrangement well known and therefore not further described here.

Figure 3:
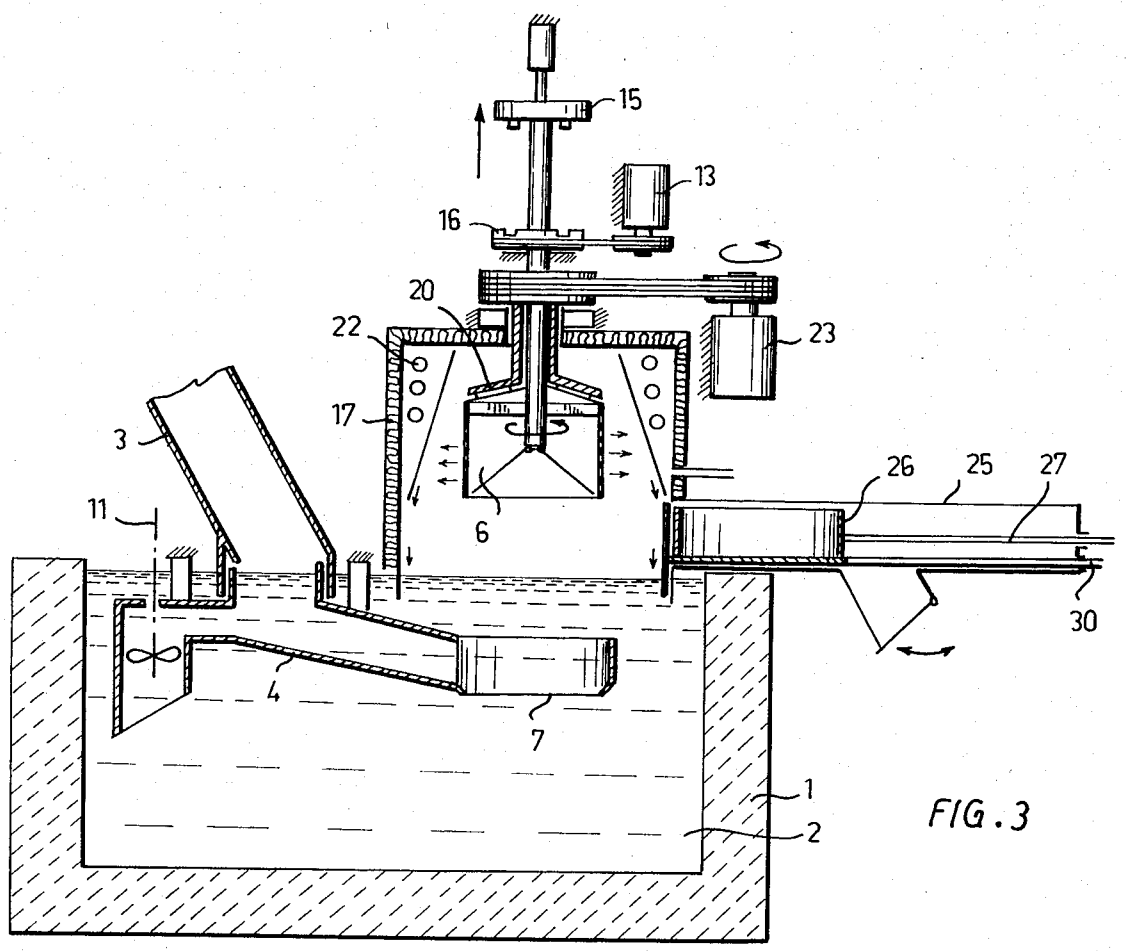
FIG. 3 illustrates the centrifuging step.

The adjustment of the thickness of the zinc coating takes place, as in a conventional method, by means of centrifuging, as shown in FIG. 3. Above the zinc bath is mounted a centrifuging chamber 17 which through a wall protrusion 18 forms a tight gas seal and is filled with nitrogen gas which prevents the oxidation of the aluminium in the eutectic alloy during centrifugation and thus improves the centrifuging result. The centrifuging cage 6 is lifted up by means of e.g. a hydraulic cylinder not shown, into a firm centrifuging support 20 which has clutch means 21 engaging corresponding clutch means 9 on top of the cage cover 8 and is rotated in cycles of about 10 seconds in a reciprocating manner, at a speed of e.g. 200–500 r.p.m., by an electric motor 23 the rotary speed of which is steplessly adjustable, over e.g. a chain or belt transmission 24. The centrifuging efficiency depends on the rotary speed of the centrifuge, and a desired coating thickness can be achieved by adjusting the rotary speed. The centrifuging chamber 17 can, when required, be heated by means of electric resistances 22 so that a too early solidification of the molten zinc alloy can be eliminated. Surplus molten zinc hurled on the walls 19 of the chamber due to the centrifugation flows back into the zinc bath.

Figure 4:
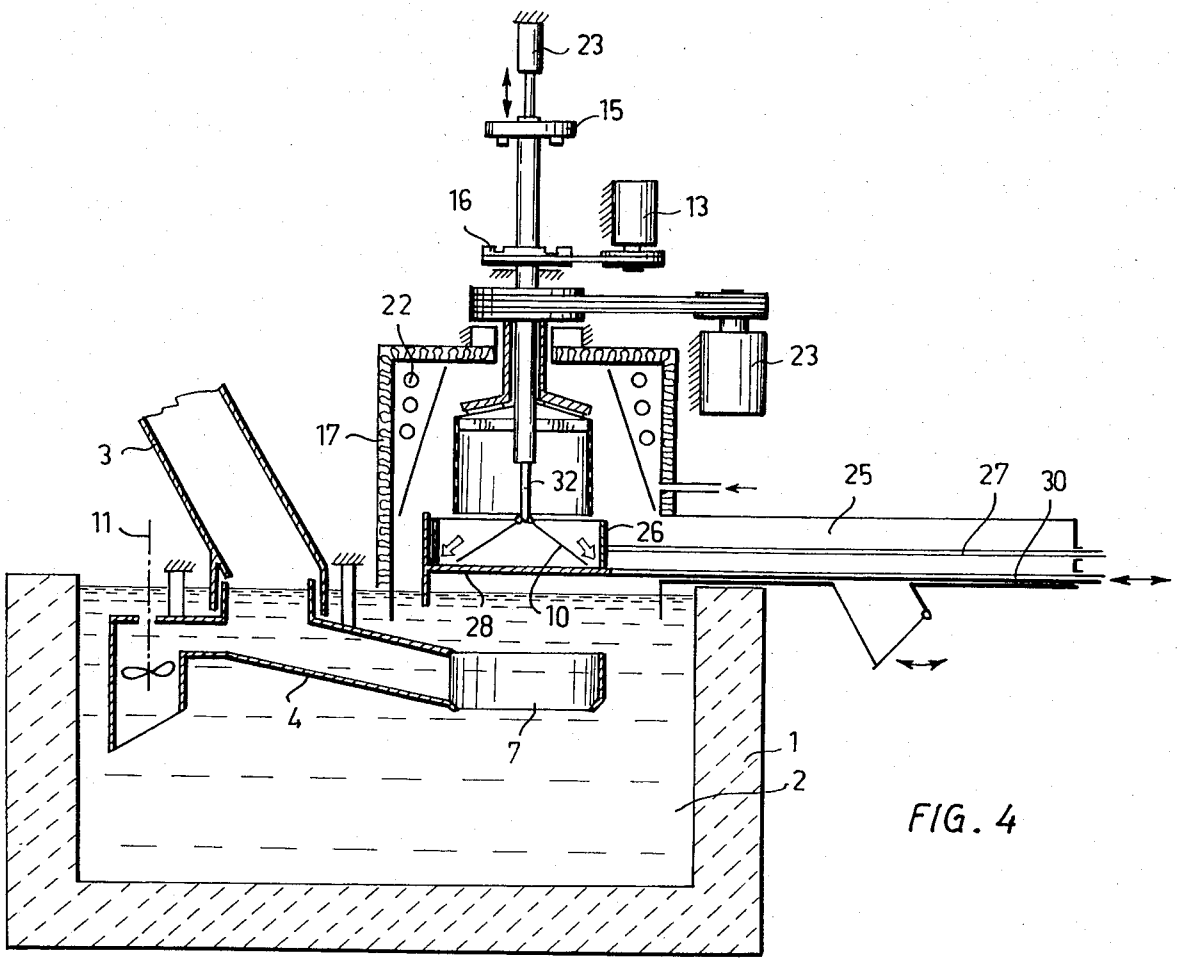
FIG. 4 illustrates the step of removing the coated objects from the centrifuging chamber.

After centrifugation, the steel objects are discharged, according to FIG. 4, onto a tray 28 pushed in from the side of the centrifuging chamber by a cylinder the piston rod of which is designated 30. At the same time, a front plate 29 of the tray cleans the surface of the zinc bath of any impurities (surface slag). Hereafter the cylinder 23 pushes the bottom cone 10 of the centrifuging cage 4 down, by a rod 32 telescopical with the shaft 12, thereby dropping the steel objects onto the tray 12. The bottom cone 10 is lifted up again and the tray 28 is returned back to a discharge chamber 25. Hereafter the centrifuged steel objects are discharged from the tray 28 by means of a transfer plate or rake 26 operated by a working cylinder the piston rod of which is designated 27.

The cage 6 is again lowered into the bath and receives a new bath of articles to be coated. The cover 8 of the cage 6 axially releasable from the cage and stops on top of the annular plate 7. In the position of FIGS. 3 and 4 the cover 8 of the cage 6 is of course not rotatable with respect to the support 20, although no specific means to this effect are shown in the drawing, the arrangement of such means will not present difficulties for a person skilled in the art.

What I claim is:

1. Apparatus for coating steel objects with an alloy of zinc and aluminium, comprising, a bath containing a molten alloy of zinc and about 5% of aluminium, means for feeding steel objects, preheated to a temperature within the range 400° C.–950° C., into the bath, a centrifuging chamber above the bath and containing an oxygen-free atmosphere, a cage means movable between a first position within the bath, in which position the cage means is arranged to receive the steel objects fed into the bath, and a second position in the centrifuging chamber above the bath, in which second position the cage means is arranged to rotate in order to remove excess coating material from the steel objects, a conveyor pipe being arranged within the bath for receiving the steel objects, said conveyor pipe being downwardly inclined and leading to the cage means, a pump being arranged in the conveyor pipe to produce a flow of molten metal for conveying the steel objects, and means for removing the steel objects from the cage means to the outside of the centrifuging chamber, after the centrifugation.

2. An apparatus according to claim 1, wherein the conveyor pipe is in communication with the cage through an annular guide plate at the upper end of the cage when said cage is in its first position, said guide plate centering the cage and preventing steel objects from escaping out of the cage.

3. An apparatus according to claim 2, wherein the cage means is provided with a releasable cover arranged to be withheld on top of the annular guide plate as the cage passes downwards therethrough, said cover ensuring that no steel objects escape over the guide plate and preventing impurities on the bath surface from entering the cage while lifting the same out of the bath into the centrifuging chamber and being provided with means for connection to a centrifuging support when the cage is in its second position, in the centrifuging chamber.

4. An apparatus according to claim 1, wherein the cage means is arranged to rotate around a vertical shaft while being in the first position.

5. An apparatus according to claim 4, wherein the cage means is provided with a conical bottom widening downwards.

6. An apparatus according to claim 5, wherein the conical bottom is arranged to be lowered from the cage.

7. An apparatus according to claim 5, wherein the means for removing the steel objects from the cage means comprise a discharge chamber at the side of the centrifuging chamber and a tray pushable from the discharge chamber into the centrifuging chamber to a position underneath the cage means for receiving steel objects from the cage means as the bottom of the latter is lowered onto the tray.

8. An apparatus according to claim 7, wherein the tray is provided with a front plate extending down into the bath, for removing impurities from the bath surface underneath the cage means as the tray is pushed into the centrifuging chamber.

9. An apparatus according to claim 7, wherein on the tray is provided a transfer plate movable with the tray to the position underneath the cage means and movable independently of the tray when this is within the discharge chamber, for transferring the coated steel objects from the tray to a discharge chute.

10. An apparatus according to claim 1, wherein the centrifuging chamber is provided with heating means, in order to prevent too rapid cooling of the zinc-aluminium coating.

11. An apparatus according to claim 10, wherein a baffling wall is arranged between the cage and the heating means.

* * * * *